US005959518A

United States Patent [19]

Passow

[11] Patent Number: 5,959,518

[45] Date of Patent: Sep. 28, 1999

[54] CONTACT MECHANISM FOR ELECTRONIC OVERLOAD RELAYS

[75] Inventor: Christian Henry Passow, Batavia, Ill.

[73] Assignee: Siemens Energy & Automation, Inc., Alpharetta, Ga.

[21] Appl. No.: 09/079,709

[22] Filed: May 15, 1998

[51] Int. Cl.[6] ..... H01H 51/22

[52] U.S. Cl. ..... 335/78; 335/113

[58] Field of Search ..... 335/78–86, 126, 335/127, 124, 128, 129, 130, 131, 115, 116, 113

[56] References Cited

U.S. PATENT DOCUMENTS 3,997,861 12/1976 VanSickle ..... 335/161
5,657,002 8/1997 Ogden ..... 340/650

*Primary Examiner*—Lincoln Donovan

[57] ABSTRACT

The potential for an unreliable indication of a tripped overload relay is eliminated in a trip mechanism for an overload relay that includes a housing, and armature mounted in the housing for movement between two contact opening or closing positions, fixed contacts in the housing and moveable contacts engageable by the armature to be moved thereby toward and away from the fixed contacts and. A moveable lever is associated with the armature and is operable to shift the armature from one of the contact opening or closing positions to the other of the contact opening or closing positions. An operator for the lever is moveable toward and away from the lever and carries a spring finger. The spring finger is engageable with the lever to cause the lever to shift the armature between the positions. The spring finger is moveable with the operator in a path from a first position disengaged from the lever to a second position engaged with the lever and then to a third position disengaged from the lever. A cocking surface is carried by the housing adjacent the path to be engaged by the spring finger as it moves from the first position toward the second position to load the spring finger sufficiently that upon the finger obtaining the second position, it will contain sufficient stored energy to cause a shift of the armature.

10 Claims, 6 Drawing Sheets

CONTACT MECHANISM FOR ELECTRONIC OVERLOAD RELAYS

FIELD OF THE INVENTION

This invention relates to electrical relays, and more particularly, to a trip mechanism for an overload relay.

BACKGROUND OF THE INVENTION

Overload relays are electrical switches typically employed in industrial settings to protect electrical equipment from damage due to overheating in turn caused by excessive current flow. In a typical case, the electrical equipment is a three-phase motor which is connected to a power source through another relay commonly referred to as a contactor. A typical contactor is a heavy duty relay having three switched power paths for making and breaking each of the circuits connected to the three phase power source. The motion required to make and break the contacts is provided magnetically as a result of current flow through a coil which in turn is energized by a current whose flow is controlled by another switch, typically remotely located.

In a conventional setup, an overload relay is connected in series with the control switch for the coil of the contactor. When an overload condition is detected by the overload relay, the same cuts off power to the coil of the contactor, allowing the contactor to open and disconnect the electrical equipment that is controlled by the contactor from the source of power to prevent injury to the electrical equipment.

In the past, overload relays have utilized resistive heaters for each phase which are in heat transfer relation with a bi-metallic element which in turn controls a switch. When an overload is sensed as, for example, when there is sufficient heat input from the resistive heater to the bi-metallic element, the bi-metallic element opens its associated switch to de-energize the contactor coil and disconnect the associated piece of electrical equipment from the source of power.

More recently, the resistive heater-bi-metallic element type of relay has been supplanted by electronic overload relays. See, for example, commonly assigned U.S. Pat. No. 5,179,495 issued Jan. 12, 1993, to Zuzuly, the entire disclosure of which is herein incorporated by reference. Outputs of such circuitry typically are relatively low powered and as a consequence, in order for the output to control the contactor coil current, a solid state switch may be required. The solid state switch may, in turn, control flow to a relatively low power contact mechanism which in turn is operable to control the flow of current to the contactor as well as to operate an indicator. In the usual case, the indicator will be a light which will be illuminated upon the occurrence of a disconnect resulting from an overload. One such contact mechanism is disclosed in my commonly assigned co-pending application entitled, "Trip Mechanism for an Overload Relay", Ser. No. 08/838,904, Filed Apr. 11, 1997, the entire disclosure of which is herein incorporated by reference.

In a typical case, an overload relay, once tripped, will remain in an open position, preventing the flow of current to the contactor. Consequently, in order to resume operation of the equipment being controlled by the system, the overload relay must be reset and this is typically accomplished manually. Usually, a push button is employed so that the person operating the equipment may push the push button to cause a reset of the system, closing the contacts of the overload relay to again allow current to flow to the contactor coil which in turn will close the contacts of the contactor and provide current to the electrical equipment.

At the same time, applicable standards require that the construction of the push button and associated mechanical components of the overload relay be such that the overload relay contacts may open in the event of an overload even when the push button has been or is being pushed for reset purposes. These same standards also require that the overload relay be such that it cannot be manually defeated as, for example, by jamming the push button employed for reset in a position causing resetting of the overload relay. The purpose is to prevent damage to the electrical equipment if an overload condition occurs or continues during the process of resetting the overload relay or if the overload relay reset push button is jammed in the reset position, intentionally or otherwise. In other words, the purpose of the standard is to require that the overload relay construction be such that it cannot be defeated by holding down or jamming the push button in the reset position. An overload relay having such a feature is known as a "trip-free" overload relay.

The overload relay mechanism described in my above-identified co-pending application includes a feature whereby an indicator can be operated when an overload occurs and is a trip-free overload relay. The same works extremely well for its intended purposes, but in some instances where the push button is in the reset position and a further trip occurs while the contactor coil is energized to shut down the equipment being controlled by the system, the contacts operator for that part of the system that provides an indication of a reset or a trip may encounter the push button or associated structure before the contacts used in the indicator circuit fully close resulting in an erroneous indication of the condition of the overload relay.

The present invention is directed to overcoming one or more of the above problems.

SUMMARY OF THE INVENTION

It is the principal object of the invention to provide a new and improved trip mechanism for an overload relay. More particularly, it is an object of the invention to provide such a mechanism that will always provide accurate indications of a trip-free overload relay or other electrical mechanism used in electrical switching.

An exemplary embodiment of the invention achieves the foregoing object in a mechanism for use in an electrical switching device which includes a movably mounted lever assembly that is moveable between two switching positions. Electrical contacts are operated by the lever assembly and an operator is mounted for movement in a path adjacent the lever assembly for resetting the lever assembly to one of the switching positions. The operator is moveable from a first position to a second position and then to a third position. The mechanism includes a projection moveable with the operator between the first, second and third positions and engageable with the lever assembly only when the operator is in the second position for moving the lever assembly to the one switching position and which is disengaged from the lever assembly in the first and third positions to allow the lever assembly to fully move to the other of the switching positions.

Preferably, the projection is a finger on the operator and even more preferably, is a spring finger.

In a highly preferred embodiment of the invention, the mechanism is employed as a trip mechanism for an overload relay which includes a housing with an armature mounted in the housing for movement between two contact opening or closing positions. Fixed contacts are located in the housing as are moveable contacts which are engageable by the armature to be moved thereby toward and away from the fixed contacts. A moveable lever is associated with the armature and is operable to shift the armature from one of the contact opening or closing positions to the other of the contact opening or closing positions. An operator for the lever is provided and is moveable toward and away from the lever. A spring finger is carried by the operator and is engageable with the lever to cause the lever to shift the armature from the one contact opening or closing position to the other contact opening or closing position. The spring finger is moveable with the operator in a path from a first position disengaged from the lever to a second position engaged with the lever and then to a third position disengaged from the lever. A cocking surface is carried by the housing adjacent the path of movement of the spring finger to be engaged by the spring finger as it moves from the first position toward the second position to load the spring finger sufficiently that upon the spring obtaining the second position, it will contain sufficient stored energy to cause the shift of the armature. The spring, when in the third position, is in a non-obstructing relation to the lever to allow the lever to fully return the armature to the one contact opening or closing position.

Preferably, the operator is a manually operable reset operator and more preferably is a push button.

In a preferred embodiment, the spring finger is an end of a torsion spring coil mounted on the operator.

In a highly preferred embodiment of the invention, the armature is pivotally mounted within the housing for movement between the two contact opening or closing positions.

Additional objects and advantages of the invention will be set forth in the description which follows and in part will be obvious from the description, or may be learned by practice of the invention. The objects and advantages of the invention may be realized and obtained by means of the instrumentalities and combinations particularly pointed out in the appended claims.

DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENT

Figure 1:
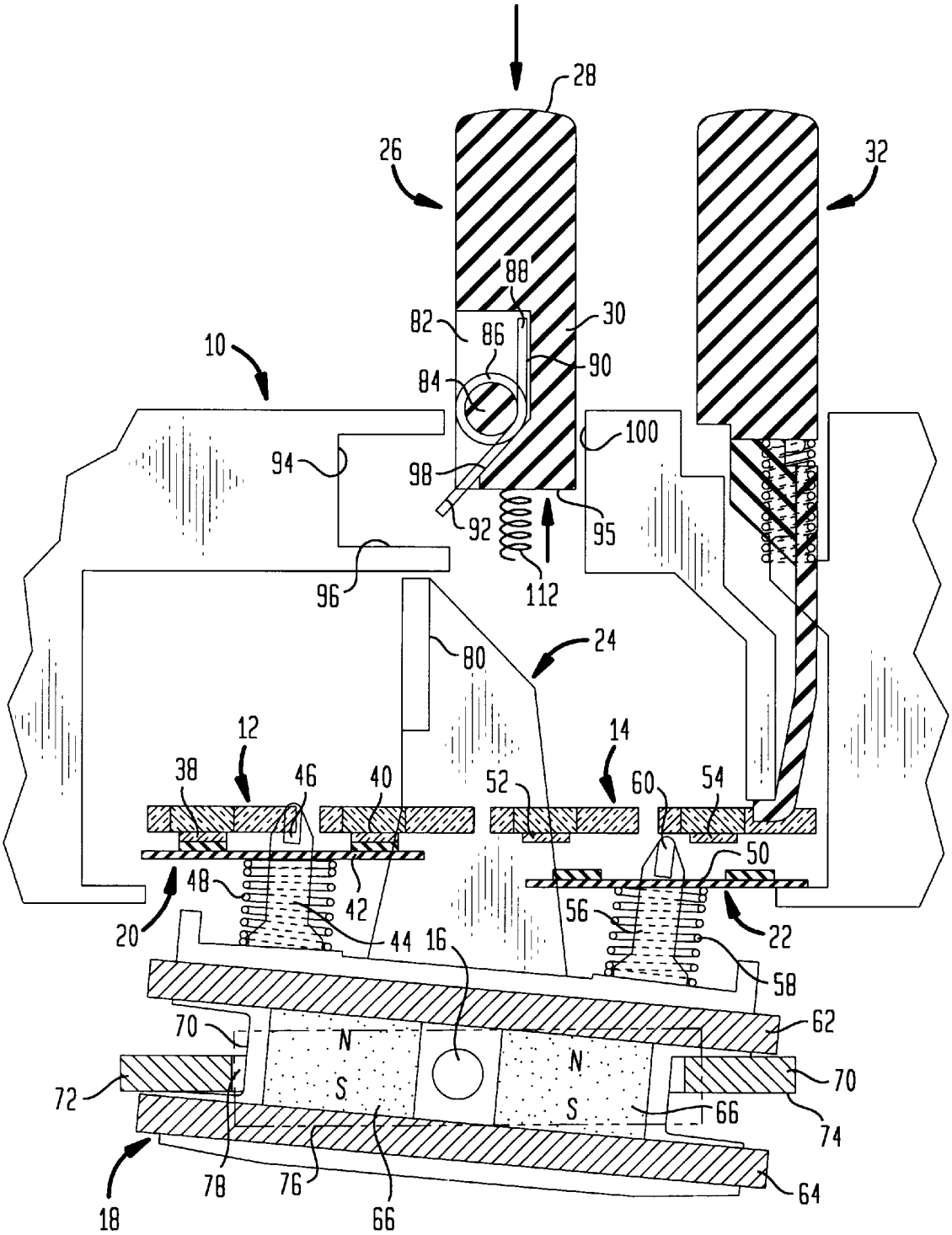
FIG. 1 is a somewhat schematic, sectional view of a trip mechanism made according to the invention showing the configuration of the components in the tripped position with the reset operator in its normal position

Referring to FIG. 1, the trip-free overload relay of the present invention is shown in a tripped position and includes a housing, generally designated 10. The housing mounts a first set of normally open fixed contacts, generally designated 12, and a set of normally closed, fixed contacts, generally designated 14. The housing includes a pivot pin 16 upon which an elongated, bi-stable armature, generally designated 18, is pivotally mounted. The armature 18 carries a first set of moveable contacts, generally designated 20, and a second set of moveable contacts generally designated 22, which move toward and away from the fixed contacts 12 and 14 respectively.

A latch lever generally designated 24, is connected to the armature 18 to be moveable therewith and thus rock about the pivot 16 between the two stable positions of the armature 18.

The housing mounts a manual operator, generally designated 26, which is a reset operator and which includes a push button 28 and a depending shank 30. The same is mounted for reciprocating movement within the housing 10 generally toward and away from the latch lever 24. A manual stop operator, generally designated 32, is also reciprocally mounted within the housing 10 and may be operated to open the normally closed contacts 14,22 under the conditions described in my previously identified, co-pending application.

Turning to the fixed contacts 12, the same includes two electrically and physically spaced contacts 38 and 40. The contacts 38 and 40 are adapted to be bridged by an elongated contact bar 42 carried by the armature 18. The contact bar 42 is elongated in the same direction as the armature 18 and is loosely mounted at its midpoint on a post 44 that extends from the armature 18 in a direction generally transverse to its direction of elongation and to one side of the pivot 16. The post 44, adjacent its upper end, includes a cross member which acts as a fulcrum for the contact bar 42. A spring 48 carried by the armature 18 biases the contact bar 42 against the fulcrum 46.

The normally closed contacts 14,22 include essentially identical components including an elongated contact bar 50 and physically and electrically spaced fixed contacts 52 and 54. The contact bar 50 is carried by a post 56 on the armature 18 and is biased by a spring 58 against a cross member 60 on the post which also defines a fulcrum for the cross member 50. It will observed that the cross members 46 and 60 engage the respective contact bars 42,50 at approximately the mid-point of each.

Turning now to the armature 18, the same includes a first magnetic pole piece 62 and a parallel, spaced, second magnetic pole piece 64. The pole pieces 62 and 64 sandwich the pivot 16 as well as two permanent magnets 66. The permanent magnets 66 could be a unitary structure but for convenience and to accommodate the pivot 16, they are shown as two separate magnets.

The housing 10 mounts a magnetic yoke or pole piece 70 which is in the form of a shallow "U" having legs 72 and 74. As schematically shown in FIG. 1, an electrical coil 76 is disposed about the bight of 78 of the pole piece 70. In some cases, the electrical winding 76 will be a single coil while in other cases, two electrically separate coils will be wound thereon, one on top of the other. The particular arrangement depends upon the control mode of the electronic circuitry employed with the mechanism. If the same reverses current flow through the coil 76 to switch the relay from one state to another, only a single coil need be used. On the other hand, if the same does not reverse current flow, but rather switches it from one coil to the other, then two coils, oppositely wound from one another, will be employed as the coil 76.

Figure 4:
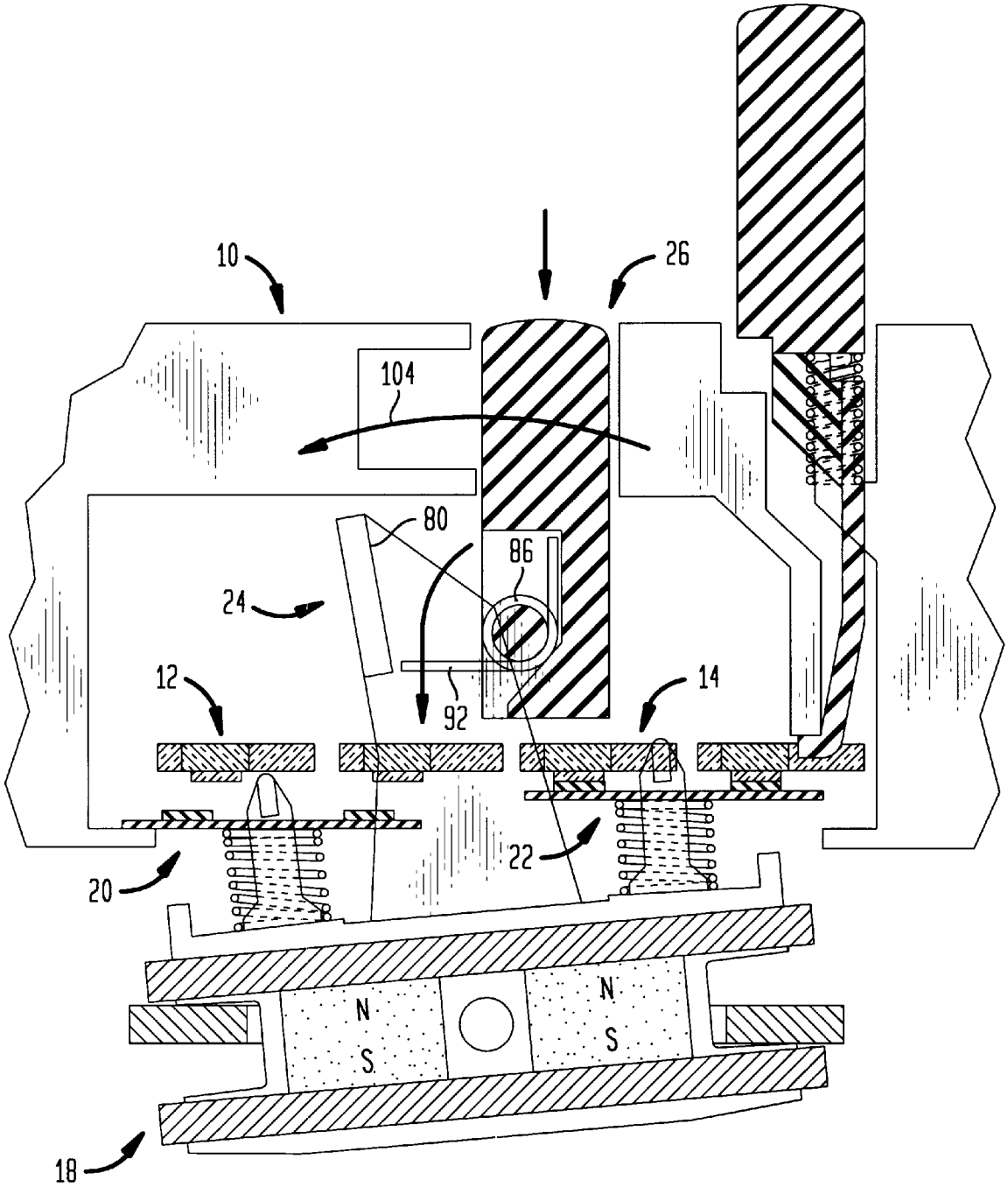
FIG. 4 is a view similar to FIGS. 1–3 but illustrating the position of the components when resetting has been completed.

Turning now to the latch lever 24, the same is moveable between the positions shown in FIGS. 1 and 4, for example. At its upper end, the latch lever includes a striking surface 80. The shank 30 of the operator 26 includes a cavity 82 with an internal mounting pin 84. The coil 86 of a torsion spring is disposed on the mounting pin 84. The torsion spring has an upper end 88 in close adjacency to a vertical wall 90 of the cavity 82 and an opposite end 92 which extends outwardly of the cavity 82 and downwardly to a location below the underside 95 of the shank 30 of the operator 26.

The housing in turn includes a recess 94 just above the lever 24 and the lower side 96 of the recess 94 underlies and is in the path of movement of the end 92 of the torsion spring 86. Normally, the end 92 of the torsion spring abuts a diagonal lower surface 98 of the cavity 82 as illustrated in FIG. 1.

The operator is received in an opening 100 in the housing 10, and as noted previously, is mounted for reciprocal movement therein.

In the usual case, the contacts 14,22 close to energize the coil of a contactor which in turn controls the flow of electrical current to the equipment being controlled. The contacts 12,20 are typically employed in an indicator circuit as, for example, to control the flow of current to an electric light or the like. With the components in the configuration illustrated in FIG. 1, current flow to the contactor is halted while current flow to the indicator is allowed to cause the indicator to indicate that a tripped condition has occurred.

Figure 2:
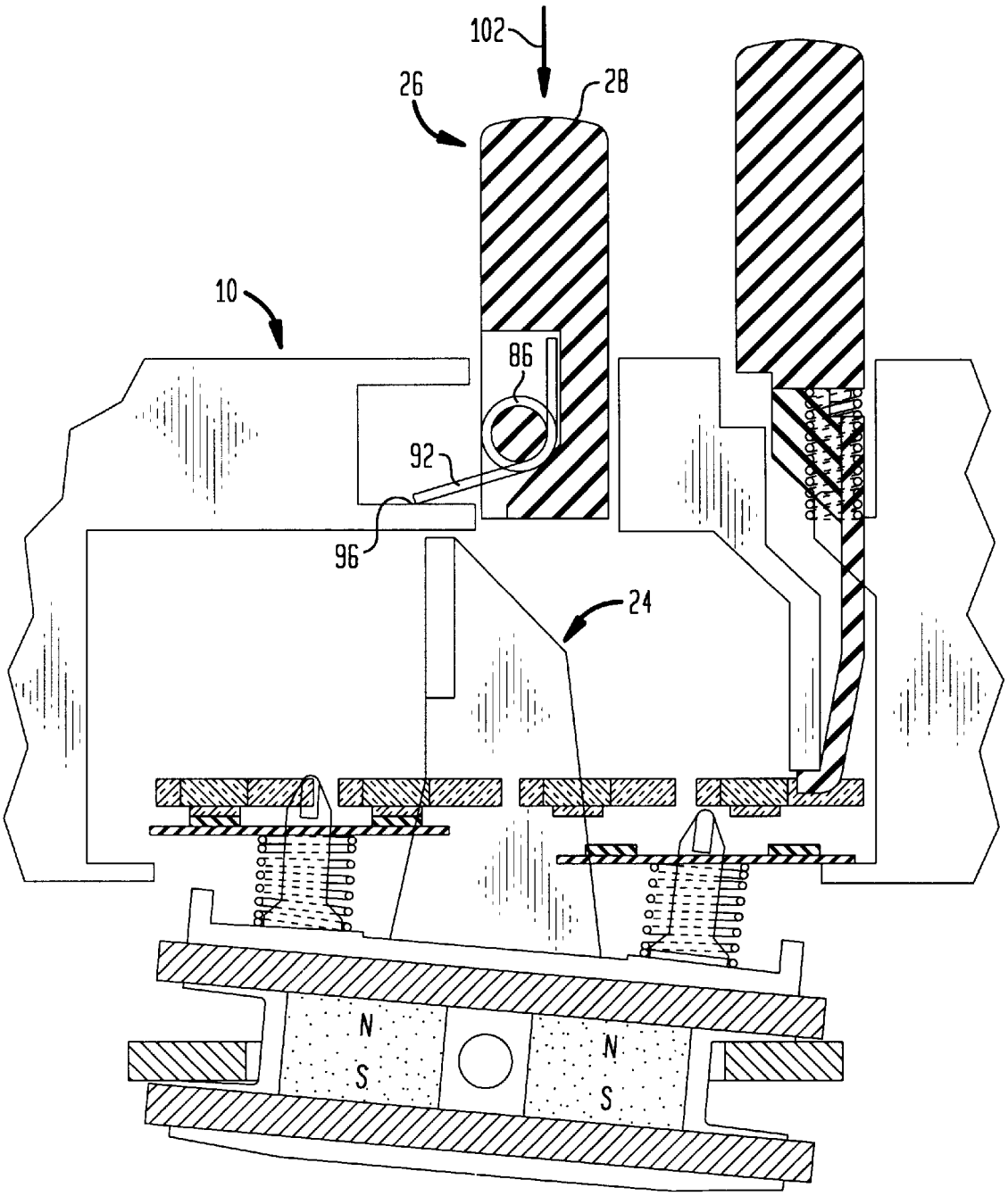
FIG. 2 is a view similar to FIG. 1 but illustrating the position of the components when the reset operator is being moved towards a resetting position.

When it is desired to reset the trip mechanism from the tripped condition illustrated in FIG. 2, a downward force indicated by an arrow 102 is applied to the push button 28. As the operator 26 moves downwardly within the housing 10, the end 92 of the torsion spring 86 encounters the surface 96 of the recess 94. The surface 96 acts as a cocking surface and cocks the spring 86.

Figure 3:
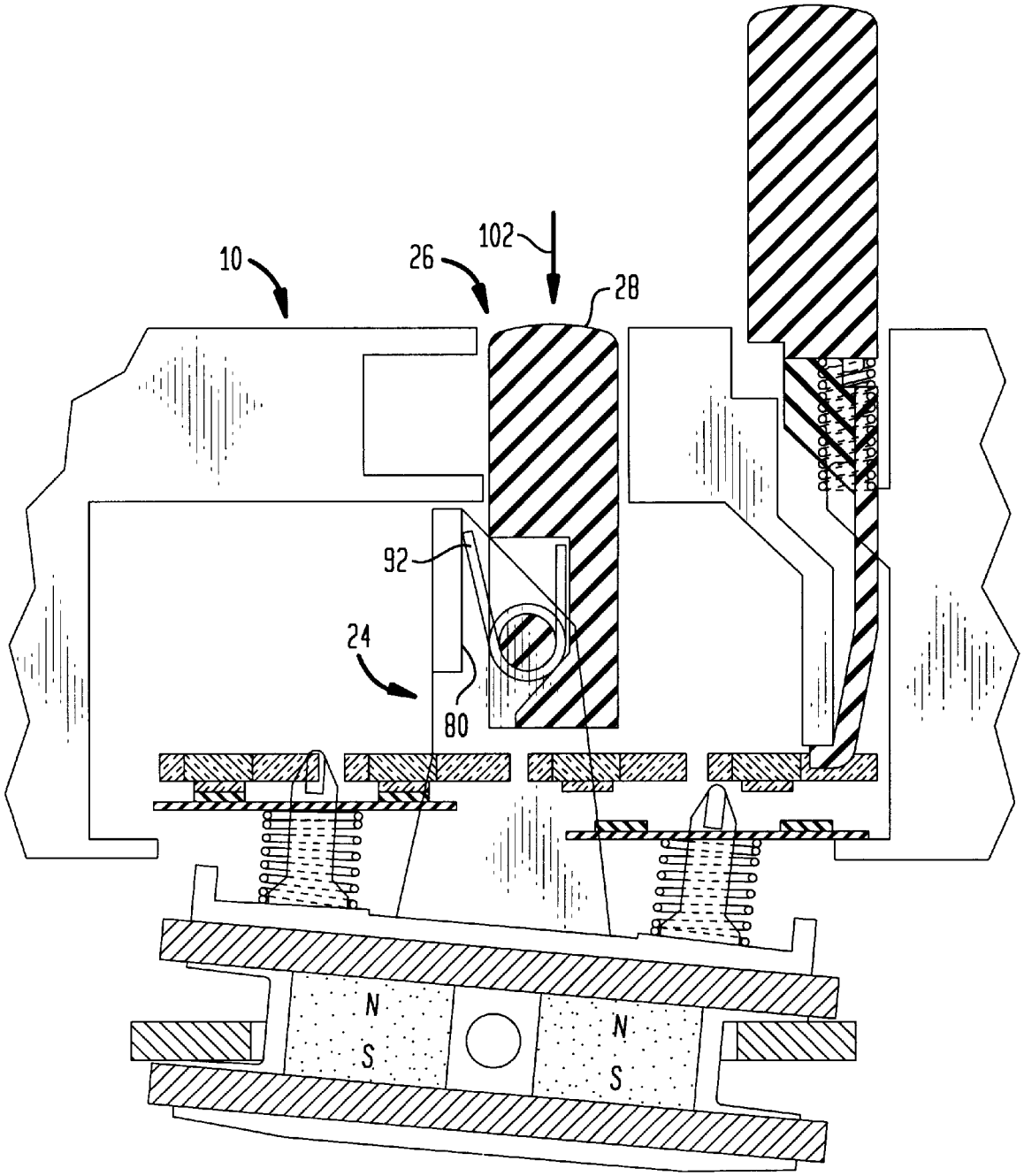
FIG. 3 is a view similar to FIGS. 1 and 2 but illustrating the configuration of the components as a reset operation is being initiated.
Figure 5:
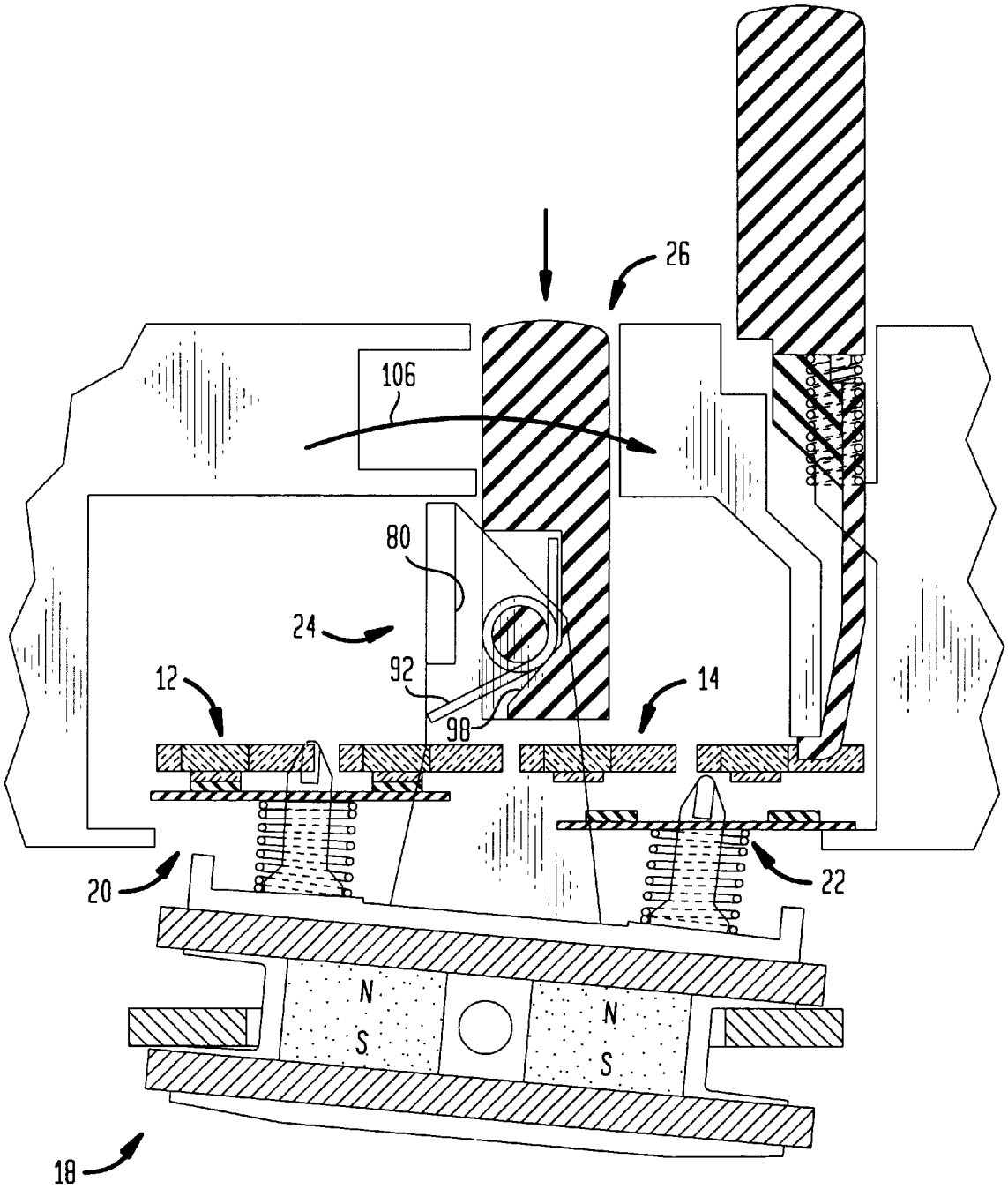
FIG. 5 is a view similar to FIGS. 1–4 with the reset operator in a resetting position but illustrating the configuration of the components when a trip has occurred at that time.

Continued downward movement of the operator 26 is illustrated in FIG. 3 and as the same moves further into the housing 10, the spring end 92 moves out of the recess 96 in an almost vertical position. As soon as it clears the housing 10, the spring end 92 snaps against the striking surface 80 and because of the pre-loading of the spring 86 provided by the cocking surface 96, the energy stored by the spring will be directed against the striking surface 80 causing the lever 24 to move in a counter clockwise direction as illustrated by an arrow 104 in FIG. 4. This in turn causes the armature 18 to move to the other of its bi-stable positions as illustrated in FIG. 4, closing the contacts 14,22 to again allow current to flow to the contactor coil and by opening the contacts 12,20 to extinguish the indicator. Once the end 92 of the coil spring 86 is free of the striking surface 80, as illustrated in FIG. 5, with the operator 26 in its lower most position, it will move to the position shown in FIG. 5 against a stop (not shown). In this location, it is in non-obstructing position to the lever 24 and the striking surface 80 such that the lever 24 may move in the direction of an arrow 106 in FIG. 5 to shift the armature 18 to a position wherein the contacts 14,22 again open to halt flow of current to the contactor coil while the contacts 12,20 again close to illuminate the indicator. That is to say, even with the reset operator 26 in a reset position, the armature 18 may move to a tripped condition to halt operation of the contactor and initiate operation of an indicator.

Figure 6:
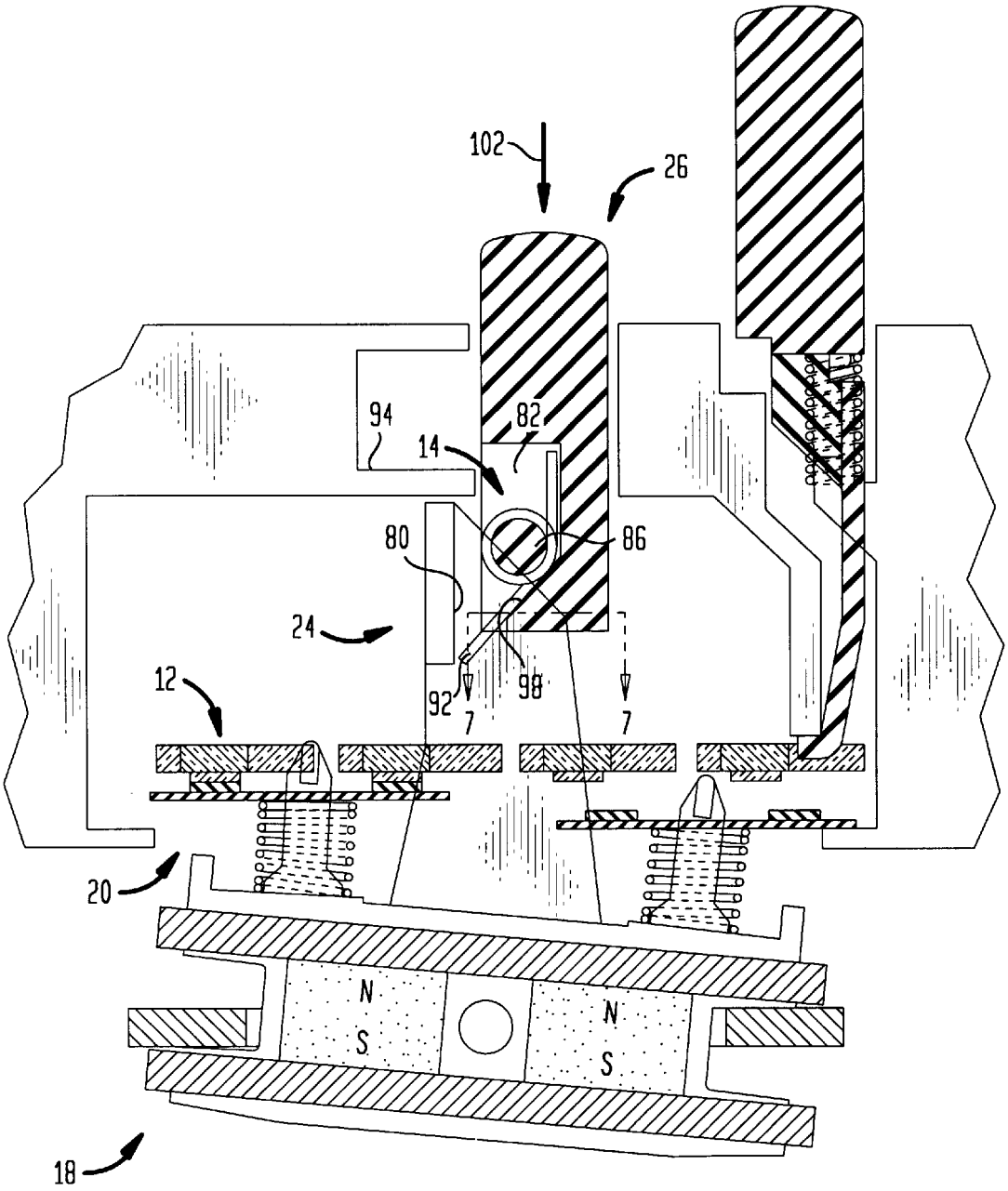
FIG. 6 is a view similar to FIGS. 1–5 but illustrating the configuration of the components when tripped for any intermediate position of the reset operator.
Figure 7:
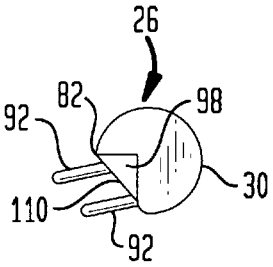
FIG. 7 is a sectional view taken approximately along the line 7—7 in FIG. 6.

FIG. 6 indicates a further possible condition wherein the operator 26 is only partially depressed as might be the case if it were jammed. It also illustrates the advantage of the invention. In this situation, the spring end 92 has bottomed out against the lower surface 98 of the cavity 82 but is still in a non-obstructing relation to the striking surface 80 of the lever 24 allowing full movement of the armature 18 to its tripped position. That is to say, the spring end 92, when the spring 86 is not cocked, is out of the path of movement of the striking surface 80 to allow full movement of the armature 18 between its two bi-stable positions. As a consequence, the contacts 12,20 are fully closed to provide an accurate indication that the relay has been tripped. Thus, the construction of the invention avoids any interference between the lever 24 and the operator 26 that might prevent full movement of the armature 18 to its tripped position such that the indicator operating contacts 12,20 do not fully close. A false indication is therefore avoided.

In some cases, the lower surface 98 of the cavity 82 in the operator 26 may desirably be angled as shown in 110 to one side of the operator 26 or the other. In such a case, upon upward movement of the operator 26 under the influence of a biasing spring 112 such as schematically shown in FIG. 1 the spring end 92 will strike the end 114 of the cocking surface 94 and deflect to one side of the same to clear the end 114 to allow the operator 26 to return to its full uppermost position. Of course, if the bias provided by the spring 112 is strong enough, the diagonal surface 110 may be eliminated as the spring end 92 may simply deflect sufficiently to pass about the end 114 of the cocking surface 96. Alternatively, the diagonal surface 98 may be omitted and the upper end 88 of the spring 86 affixed to the operator 26 in the position shown in FIG. 1, for example. As still another alternative, the underside of the cocking surface 96 may be sloped into or out of the plane of the paper bearing FIG. 1 to cam the finger 92 to one side or the other to pass the end 114 of the cocking surface 96.

From the foregoing, it will be appreciated that a trip mechanism made according to the invention assures that the resetting projection provided by the spring end 94 is out of engagement with the lever 24 except when it has been previously cocked to reset mechanism. Once resetting has occurred, no obstruction to full movement of the armature to a tripped condition occurs with the consequence that contacts for an indicator circuit fully close to provide a reliable indication that the mechanism has been tripped.

Additional advantages and modifications will readily occur to those skilled in the art. Therefore, the invention in its broader aspects is not limited to the specific details, and representative devices, shown and described herein. Accordingly, various modifications may be made within departing from the spirit or scope of the general inventive concept as defined by the appended claims and their equivalents.

I claim:

1. A trip mechanism for an overload relay comprising:

a housing;

an armature mounted in said housing for movement between two contact opening or closing positions;

fixed contacts in said housing;

moveable contacts engageable by said armature to be moved thereby toward and away from said fixed contacts;

a moveable lever associated with said armature and operable to shift said armature from one of said contact opening or closing positions to the other of said contact opening or closing positions;

an operator for said lever moveable toward and away from said lever;

a spring finger carried by said operator, said spring finger being engageable with said lever to cause said lever to shift said armature from said one contact opening or closing position to said other contact opening or closing position, said spring finger being moveable with said operator in a path from a first position disengaged from said lever to a second position engaged with said lever and then to a third position disengaged from said lever; and a cocking surface carried by said housing adjacent to said path to be engaged by said spring finger as it moves from said first position toward said second position to load said spring finger sufficiently that upon the spring finger attaining said second position, it will contain sufficient stored energy to cause said shift of said armature;

said spring finger, when in said third position, being in non-obstructing relation to said lever to allow said lever to fully return said armature to said one contact opening or closing position.

2. The mechanism of claim 1 wherein said operator is a manually operable reset operator.

3. The mechanism of claim 2 wherein said reset operator is a push button.

4. The mechanism of claim 1 wherein said spring finger is an end of a torsion spring coil mounted on said operator.

5. The mechanism of claim 1 wherein said armature is pivotally mounted within said housing for said movement between said two contact opening or closing positions.

6. Mechanism for use in an electrical switching device comprising:

a pivotally mounted lever assembly moveable between two switching positions;

electrical contacts operated by said lever assembly;

an operator mounted for generally reciprocal movement in a path adjacent said lever assembly for resetting said lever assembly to one of said switching positions, said operator being moveable from a first position to a second position and then to a third position; and a projection moveable with said operator between said first, second and third positions and engageable with said lever assembly only when said operator is in said second position for moving said lever assembly to said one switching position and being disengaged from said lever assembly in said first and third positions to allow said lever assembly to fully move to the other of said switching positions.

7. The mechanism of claim 6 wherein said projection comprises a finger on said operator.

8. The mechanism of claim 7 wherein said finger is a spring finger.

9. The mechanism of claim 8 further including a cocking surface for loading said spring finger to move into engagement with said lever assembly when said operator moves from said first position toward said second position, said spring finger normally assuming a position out of engagement with said lever assembly except upon being released by said cocking surface as said operator moves from said first position to said second position.

10. The mechanism of claim 9 wherein said lever assembly includes a striking surface adapted to be engaged by said spring finger.

* * * * *